United States Patent [19]

Handler

[11] 4,434,534

[45] Mar. 6, 1984

[54] HOLDING-DOWN AND CLAMPING DEVICE FOR SHACKLE MECHANISMS

[76] Inventor: Anthony Handler, Mühlbachergasse 14, Vienna, Austria, A-1130

[21] Appl. No.: 341,291

[22] Filed: Jan. 21, 1982

[30] Foreign Application Priority Data

Feb. 4, 1981 [AT] Austria ..... 491/81

[51] Int. Cl.[3] ..... B42F 13/00; B42F 3/00; B42F 1/00

[52] U.S. Cl. ..... 24/67.1; 24/67.11; 402/80 L; 402/60

[58] Field of Search ..... 24/67 R, 153, 67 P, 24/153.1, 67.1, 154, 67.3, 67.5, 67.7, 67.9, 67.11; 402/24, 68, 25, 69, 26, 37, 70, 38, 71, 39, 80 L, 60; 281/21 A, 24, 25 A, 26, 28, 34, 50; 40/535, 536, 400, 403, 308; 248/351, 353

[56] References Cited

U.S. PATENT DOCUMENTS

| | | | |
|---|---|---|---|
| 668,616 | 2/1901 | Aberle | 402/68 |
| 783,319 | 2/1905 | Schuckar | 402/60 |
| 904,543 | 11/1908 | Liscom | 402/68 |
| 2,120,659 | 6/1938 | Wedge | 402/60 |
| 2,439,826 | 4/1948 | Snyder | 24/67 P |
| 2,493,052 | 1/1950 | Yale | 24/67 P |
| 3,503,695 | 3/1970 | Giampa | 402/24 |

FOREIGN PATENT DOCUMENTS

| | | | |
|---|---|---|---|
| 18352 | of 1906 | United Kingdom | 24/67.1 |

*Primary Examiner*—Gene Mancene
*Assistant Examiner*—David Tarnoff
*Attorney, Agent, or Firm*—Kurt Kelman

[57] ABSTRACT

A clamping device for shackle mechanisms which can also be used as a tear-open safeguard and as a sheet turner consists of a flat body (8) with two L-shaped apertures (9,9'), one leg (10,10') of each aperture (9,9') extending parallel to the plane of the sheet shackels (17,17') and the legs (11,11') extending transversely thereto being arranged in line, also on the flat body (8) there are two hook-shaped portions (12,12') with a mouth (13,13'), this mouth (13,13') extending, over the distance of the sheet-shackle legs (4,5), parallel to the transverse leg (11,11') of the aperture (9,9') and the mouth (13,13') and transverse leg (11,11') being clampable firmly to the sheet-shackle legs (4,5).

5 Claims, 4 Drawing Figures

Figure 4:
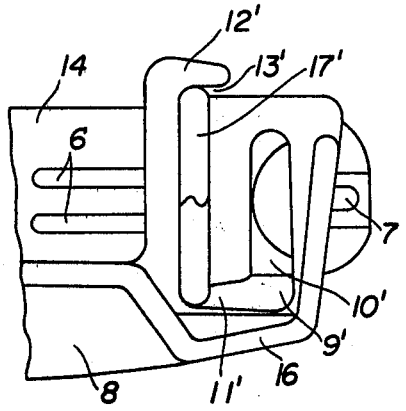

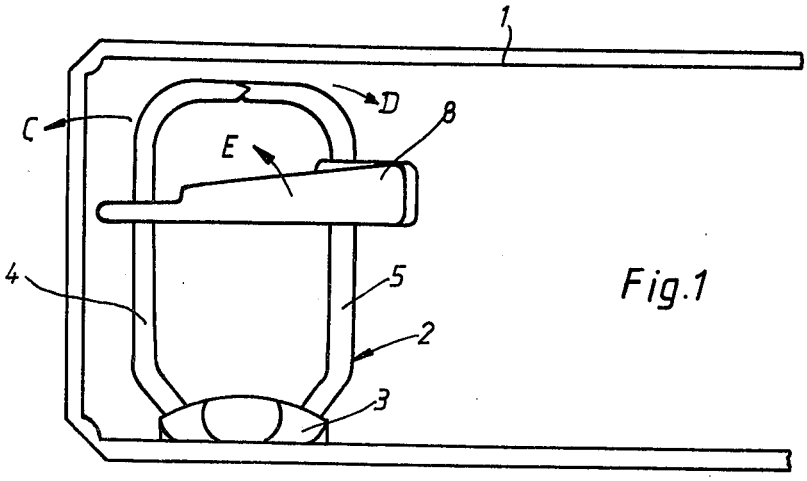
Fig.1
Fig.2
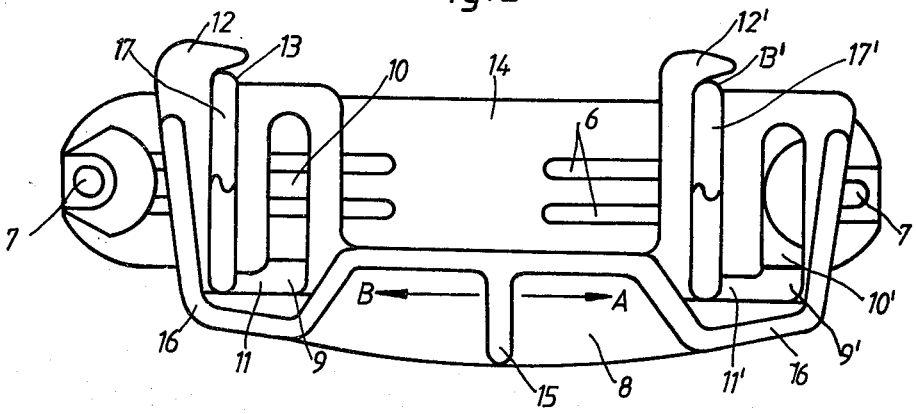
Fig.3
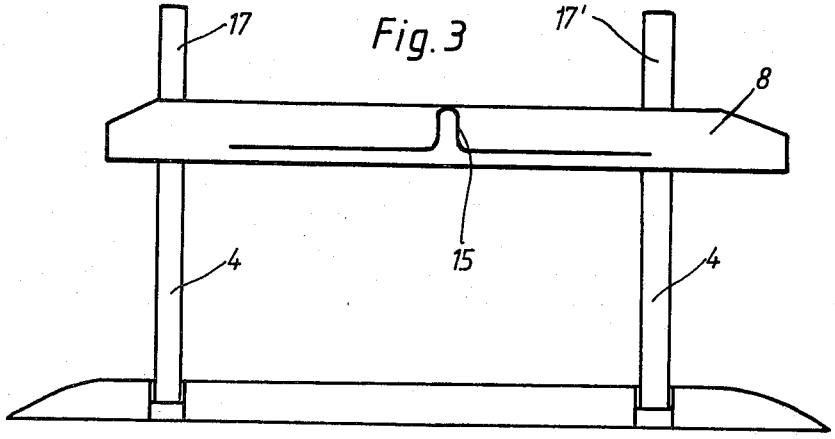

HOLDING-DOWN AND CLAMPING DEVICE FOR SHACKLE MECHANISMS

This invention relates to a clamping device for a paper filing system having at least two sheet-receiving shackles located at a distance from one another for receiving punched paper, the shackle legs extending parallel to one another and projecting from a mechanism box and the clamping device having apertures for the passage of the shackle legs and being clampable firmly to the shackle legs.

One known device of this type has a clamping lever which, when actuated, causes two clamping pins to be pressed against the legs of the sheet shackle, as a result of which the camping device is retained in its position. Devices of this known type are of complicated construction and are expensive to produce.

The object of the invention is to develop a clamping device which can be produced simply for example from plastics material by injection moulding and which, at the same time, can also be used as a tear-open safeguard for the shackle mechanism and as a sheet turner.

The invention provides a clamping device for a paper filing system having at least two spaced apart sheet receiving shackles for receiving punched paper which comprises a substantially flat body portion having at least two spaced L-shaped apertures, the spacing between the apertures at corresponding portions thereof corresponding to the spacing between the sheet receiving shackles, the shackles lying in parallel planes and one leg of each apperture extending parallel to the planes containing the shackles and the other leg of each aperture extending transversely to said planes, the transverse legs being aligned one with the other, the body portion also having at least two hook portions, one associated with each aperture in the body portion and each defining, with the remainder of the body portion, a mouth for receiving one leg of a shackle, the hook portions extending substantially parallel to the transverse leg of the associated apertures and the spacing between each hook portion and its associated transverse leg being substantially equal to the spacing of the two legs of each shackle so that the shackle can be clamped to the clamping device when one leg is engaged in the transverse leg of the aperture and the other leg is engaged in the associated hook shaped extension.

The invention will now be described in more detail with reference to the drawing. In the drawing, FIG. 1 shows a front view of a file with a shackle mechanism and with a clamping device according to the invention, FIG. 2 shows a plan view of the shackle mechanism of the file according to FIG. 1, with the file lid lifted off, FIG. 3 shows a side view of the mechanism with the clamping device according to the invention according to FIGS. 1 and 2, and FIG. 4 is a fragmentary view showing a modified detail.

The drawings illustrate a file 1 with a shackle mechanism 2. The shackle mechanism 2 possesses a mechanism box 3 which is provided with reinforcing ribs 6 and from which project shakle legs 4,5 forming the sheet shackles. The shackle legs 4,5 are arranged parallel to one another and are fastened on the underside in a way known per se to spring strips (not shown) located in the box 3. The shackle legs 4,5 can be opened in the direction of the arrows C and D. The mechanism 2 is fastened to the file 1 at the points 7 in a known way, for example by riveting.

The clamping device consists of a body 8 with a U-shaped recess 14 on one side. The edge of the other side has a continuous reinforcing rib 16 from which a further rib section 15 projects in the central region. The clamping device 8 possesses two L-shaped apertures 9,9' arranged parallel to one another and spaced apart by the same spacing as the two shackles 17,17'. The transverse legs 11,11' of the apertures 9,9' are arranged in line. A hool-shaped extension 12,12' with a bite 13,13' is associated with each L-shaped aperture 9,9'. The bite 13,13' extends parallel to the transverse leg 11,11' of the aperture 9,9' and the width of the body between the bite 13 and its associated transverse leg 11 is equal to the distance between the shackle legs 4,5. The width of the bite 13,13' and of the transverse leg 11,11' is selected so that the clamping device 8 can be clamped firmly to the shackle legs 4,5 by lateral movement of the clamping device 8 in the direction of the arrow A.

For this purpose, the edges of the bite 13,13' and/or of the transverse legs 11,11' can be wedge-shaped.

The clamping device 8 according to the invention works as follows. In the illustrated position, the shackle legs 4 and 5 are clamped firmly in the bites 13,13' and in the transverse legs 11,11', as a result of which the clamping device 8 is retained in a definite position holding down the paper material (not shown). In this position the legs 4,5 of the shackle are also secured against opening (arrows C,D). In this position, a safeguard against tearing open is consequently provided. When the clamping device 8 is grasped by the rib section 15 serving as a gripping strip and is moved in the direction of the arrow B, the legs 4,5 of the sheet shackle 2 are released from the bites 13,13' and the transverse legs 11,11' and the legs of the shackle can be separated. At the same time, the shackle legs can move freely in the legs 10,10' of the apertures 9,9'. In this position, the clamping device 8 can not only be moved parallel to the surface of the paper material, but can also be pivoted in the direction of the arrow E. As a result, the clamping device 8 according to the invention can also be used as a sheet lifter. If the paper material is to be held down again and the mechanism locked against tearing open, all that is necessary is to press the clamping device 8 against the surface of the paper material and to move it in the direction of the arrow A until the legs 4,5 of the sheet shackle are clamped firmly in the bites 13,13' and in the transverse legs 11,11'. Since, in the case of files filled with a large quantity of paper material, the holding-down device 8 according to the invention rests directly against the inner side of the lid, the lid is also protected from damage by the upper edge of the sheet shackles.

The holding-dwn device according to the invention can be used universally both for double and for multiple mechanisms with different shackle heights.

What is claimed is:

1. A clamping device for a paper filing system having at least two spaced apart sheet reciving shackles for receiving punched paper, each shackle having two legs, which comprises a substantially flat body portion having at least two spaced L-shaped apertures having two legs, the spacing between the apertures at corresponding portions thereof corresponding to the spacing between the sheet receiving shackles, the shackles lying in parallel planes and one leg of each aperture extending parallel to the planes containing the shackles and the other leg of each aperture extending transversely to said planes, the transverse legs being aligned one with the other, the body portion also having two hook portions, one associated with each aperture in the body portion and each defining a bite for receiving one leg of the shackles, the hook portions extending substantially parallel to the transverse legs of the associated apertures and the spacing between each hook portion and its associated transverse leg being substantially equal to the spacing of the two legs of each shackle so that the clamping device may be clamped to the shackles when one shackle leg is engaged in the transverse leg of the aperture and the other shackle leg is engaged in the associated hook portion bite.

2. A device according to claim 1, wherein the transverse legs of the apertures taper in the form of a wedge.

3. A device according to claim 1, wherein the bites of the hook portions are wedge-shaped.

4. A device according to claim 1, the device having on one side a U-shaped recess and on the other side a continuous reinforcing rib from which projects a rib section serving as a handle.

5. A device according to claim 1, wherein the flat body portion is injection moulded.

* * * * *